US010450121B2

(12) United States Patent
Senftleben et al.

(10) Patent No.: US 10,450,121 B2
(45) Date of Patent: Oct. 22, 2019

(54) PACKAGE FOR ACCOMMODATING PRODUCTS

(71) Applicant: Fontem Holdings 1 B.V., Amsterdam (NL)

(72) Inventors: Sebastian Senftleben, Hamburg (DE); Stefan Biel, Hamburg (DE); Fiona Collins, Hamburg (DE); Reinier Halbertsma, Amsterdam (NL)

( * ) Notice: Subject to any disclaimer, the term of this patent is extended or adjusted under 35 U.S.C. 154(b) by 78 days.

(21) Appl. No.: 15/591,737

(22) Filed: May 10, 2017

(65) Prior Publication Data

US 2017/0327291 A1 Nov. 16, 2017

(30) Foreign Application Priority Data

May 12, 2016 (EP) ..... 16169343

(51) Int. Cl.

| | |
|---|---|
| ***B65D 77/30*** | (2006.01) |
| ***B65D 77/26*** | (2006.01) |
| ***B65D 43/16*** | (2006.01) |
| ***B65D 6/00*** | (2006.01) |
| ***A24F 47/00*** | (2006.01) |

(Continued)

(52) U.S. Cl.

CPC ..... *B65D 77/30* (2013.01); *A24F 9/16* (2013.01); *A24F 15/12* (2013.01); *A24F 47/008* (2013.01); *B65D 13/04* (2013.01); *B65D 43/16* (2013.01); *B65D 77/26* (2013.01); *B65D 85/1063* (2013.01); *B65D 85/20* (2013.01); *B65D 2215/02* (2013.01); *B65D 2215/06* (2013.01)

(58) Field of Classification Search

CPC ..... B65D 77/30; B65D 13/04; B65D 43/16; B65D 77/26; B65D 85/1063; B65D 85/20; B65D 2215/02; B65D 11/12; B65D 2251/1058; B65D 2583/0468; B65D 5/38; A24F 9/16; A24F 15/12; A24F 47/008; A61J 1/035

USPC ..... 229/160.1, 146, 155; 206/531, 1.5, 755, 206/759, 773; 220/324

See application file for complete search history.

(56) References Cited

U.S. PATENT DOCUMENTS

| | | | | |
|---|---|---|---|---|
| 1,354,042 | A | 9/1920 | Hunziker | |
| 6,189,779 | B1 * | 2/2001 | Verdicchio ..... | B65D 5/2057 229/148 |

(Continued)

FOREIGN PATENT DOCUMENTS

WO 2008061026 A2 5/2008

OTHER PUBLICATIONS

European Patent Office; Extended European Search Report issued in counterpart application No. EP16169343.7. dated Dec. 6, 2016.

*Primary Examiner* — Christopher R Demeree
(74) *Attorney, Agent, or Firm* — Dykema Gossett PLLC

(57) ABSTRACT

A package for accommodating products comprises a first portion hingedly connected to a first side of a rear panel, a second portion hingedly connected to a second side of the rear panel, the second side being opposite to the first side. At least one of the first and second portion comprises at least one recess adapted to accommodate a product. The first portion, the second portion and the rear panel at least partly form a receptacle adapted for accommodating said at least one recess. The first portion and the second portion are movable between an open state of the package in which the at least one recess is accessible to a user and a closed state of the package in which the at least one recess is inaccessible to a user.

15 Claims, 4 Drawing Sheets

(51) Int. Cl.

| | |
|---|---|
| ***B65D 85/20*** | (2006.01) |
| ***A24F 9/16*** | (2006.01) |
| ***A24F 15/12*** | (2006.01) |
| ***B65D 85/10*** | (2006.01) |

(56) References Cited

U.S. PATENT DOCUMENTS

| | | | | |
|---|---|---|---|---|
| 6,193,060 | B1 * | 2/2001 | Roberts | B65D 85/1045 206/268 |
| 7,455,182 | B2 * | 11/2008 | Merckell | B65D 5/5213 206/250 |
| 7,549,541 | B2 * | 6/2009 | Brozell | B65D 83/0463 206/531 |
| 7,661,534 | B2 * | 2/2010 | Saclier | A61F 15/001 206/499 |
| 10,017,303 | B2 * | 7/2018 | Wagner | B65D 50/046 |
| 2004/0226853 | A1 | 11/2004 | Intini | |

* cited by examiner

PACKAGE FOR ACCOMMODATING PRODUCTS

CROSS-REFERENCE TO RELATED APPLICATION

This application claims priority to European patent application No. 16169343.7, filed May 12, 2016. This European application is hereby incorporated by reference as though fully set forth herein.

BACKGROUND a. Field

The present invention relates generally to electronic smoking devices and in particular to a package for accommodating electronic cigarettes or parts thereof.

b. Background Art

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

A plurality of products, e.g. electronic smoking devices or components thereof, should remain inaccessible for children. The package may exhibit an opening mechanism, which may delay or even prevent the opening by children. A challenge is to implement a mechanism in the package such that the core functions of the package are not negatively affected.

BRIEF SUMMARY

In accordance with one aspect a package for accommodating products comprises a first portion hingedly connected to a first side of a rear panel, a second portion hingedly connected to a second side of the rear panel, the second side being opposite to the first side. At least one of the first and second portion comprises at least one recess adapted to accommodate a product. The first portion, the second portion and the rear panel at least partly form a receptacle adapted for accommodating said at least one recess. The first portion and the second portion are movable between an open state of the package in which the at least one recess is accessible to a user and a closed state of the package in which the at least one recess is inaccessible to a user. Further a plurality of separate pairs of cavities and protrusions are provided, wherein the cavities are formed at the first portion and the protrusions are formed at the second portion. Each pair comprises an unlocking element adapted such that, in the closed state, the respective cavity unlocks from the respective protrusion, when a pressure is applied onto the respective unlocking element.

An advantage may be that the package can be easily opened to access and remove the accommodated product such as an electronic cigarette or parts thereof such as a battery or a cartomizer while children may effectively be prevented from accessing the package's content because the plurality of unlocking elements has to be simultaneously be activated by applying pressure which may exceed a regular children's capacity.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

Figure 1:
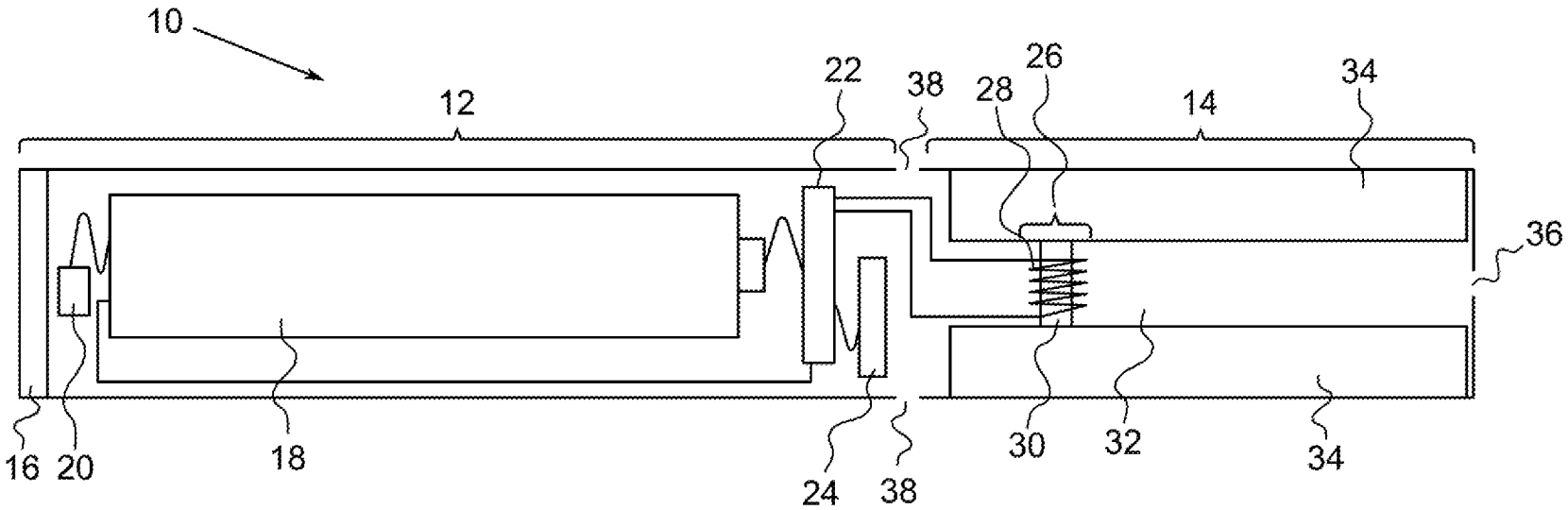
FIG. 1 is a schematic cross-sectional illustration of an exemplary e-cigarette.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims.

DETAILED DESCRIPTION OF EMBODIMENTS

The disclosure and the various features and advantageous details thereof are explained more fully with reference to the non-limiting embodiments and examples that are described and/or illustrated in the accompanying drawings and detailed in the following.

Throughout the following, an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g. steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, an LED 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarette are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
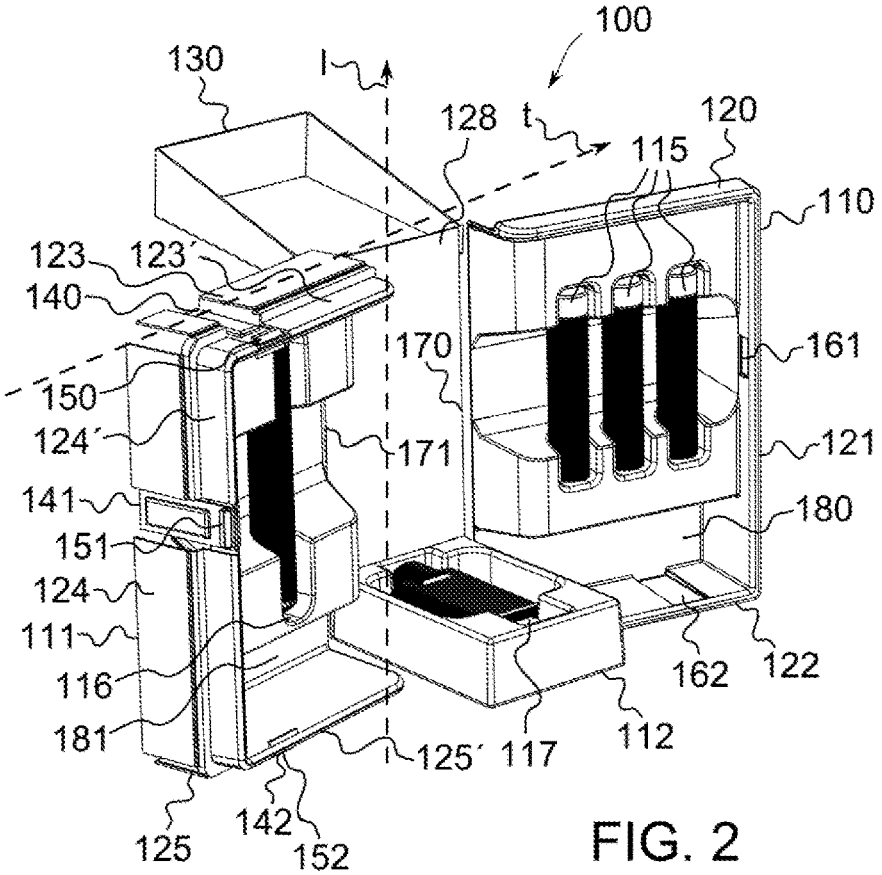
FIG. 2 is a schematic illustration of a package of an embodiment of the present invention in an open state.

FIG. 2 shows a package 100 according to an embodiment of the present invention. The package 100 is adapted to accommodate one of more e-cigarettes or part thereof such as batteries, cartomizers, atomizers, liquid reservoirs and the like.

Figure 3:
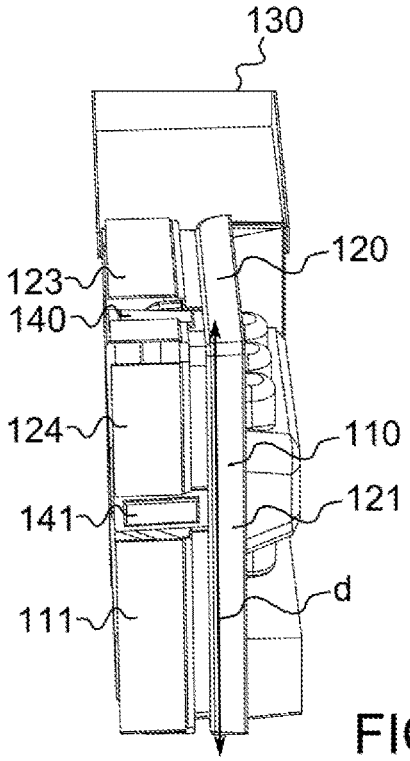
FIG. 3 is a schematic illustration of a package of an embodiment of the present invention in a closed state.
Figure 5:
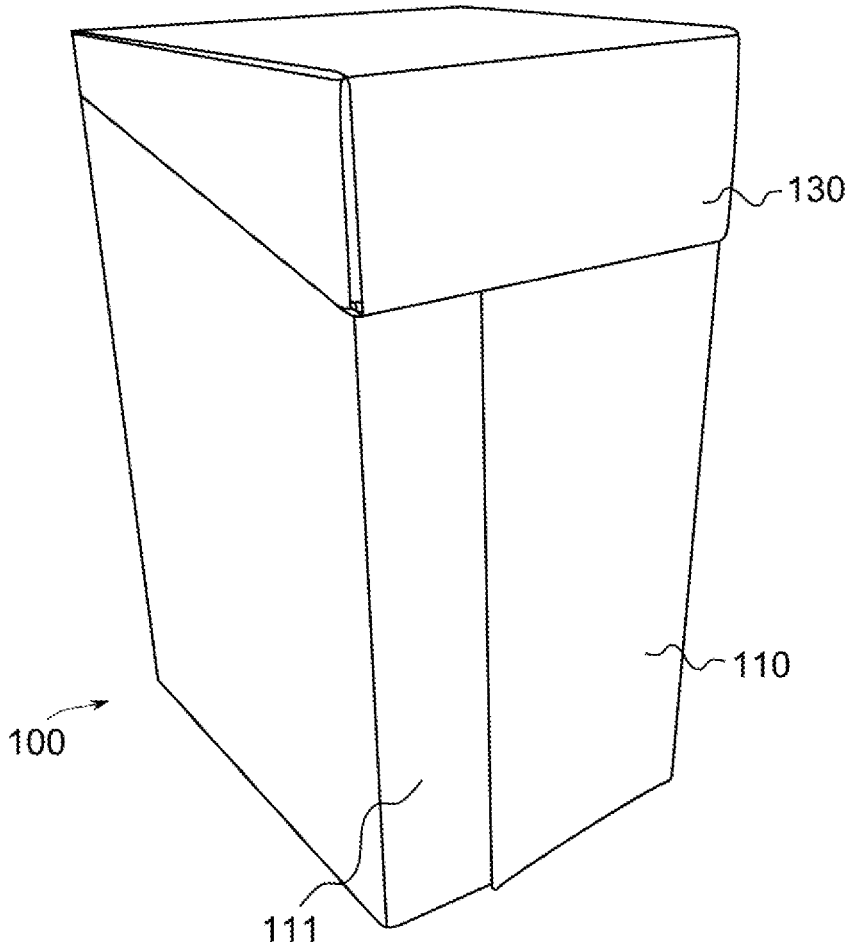
FIG. 5 is a schematic illustration of a closed package of an embodiment of the invention.

The package 100 has an open state as shown in FIG. 2 in which at least one recess 115, 116 is accessible to a user and a closed state shown in FIGS. 3 and 5 in which the at least one recess 115, 116 is inaccessible to a user.

The package 100 comprises a first portion 110 hingedly connected to a first side 170 of a rear panel 128. The package 100 comprises further a second portion 111 hingedly connected to a second side 171 of the rear panel 128, where the second side 171 is opposite to the first side 170. Due to the hinged connections, the package 100 can easily be opened like a book to store products therein or to access products stored within the package 100.

The first portion 110 comprises three first recesses 115 adapted to accommodate products. The second portion 116 comprises one second recess 116 to accommodate a product. The first portion 110, the second portion 111 and the rear panel 128 at least partly form a receptacle adapted for accommodating said three first recesses 115 and the one second recess 116. The first portion 115 and the second portion 116 are movable between an open state of the package 100, as depicted in the FIG. 2, in which the three first recesses 115 and the one second recess 116 are accessible to a user. In the closed state of the package 100, as shown in FIG. 3, the three first recesses 115 and the one second recess 116 are inaccessible to a user.

However, the present invention is not limited to the specific number and/or arrangement of the recesses 115, 116 and it would alternatively be possible to use the package of the present invention with a number and/or arrangement of the recesses.

The package comprises three pairs of cavities 160, 161, 162 and protrusions 150, 151, 152. The cavities 160, 161, 162 are formed at the first portion 110 and the protrusions 150, 151, 152 are formed at the second portion 112. Each pair comprises an unlocking element 140, 141, 142 adapted such that, in the closed state, the respective cavity 160, 161, 162 is interlocked with the respective protrusion 150, 151, 152 and can be unlocked from the respective protrusion 150, 151, 152, when a pressure is applied onto the respective unlocking element 140, 141, 142. A more detailed explanation of the locking/unlocking mechanism of the present invention is provided in connection with FIG. 4.

It is emphasized that the package 100 can only be opened if all three unlocking elements 140, 141, 142 are pressed simultaneously. Thus, if only one unlocking element 140, 141, 142 is not pressed or not sufficiently pressed, the package 100 cannot be opened. The hinged package 100 is thus accompanied with a locking function and an opening mechanism, which may prevent children to open the package 100 or at least delay the time to identify the opening mechanism. Furthermore, a child may not have the coordination to press three unlocking elements 140, 141, 142 at the same time. A further advantage may be the modular form of the package, which may reduce costs and may increase the efficiency in the production process. The opening mechanism and the book-like usage of the package 100 may provide an improved product experience when interacting with the package 100.

The first portion 110 and the second portion 111 both have the shape of a cuboid, where the height of the respective portion 110, 111, or in other words the extension of the side panels 121, 124 parallel to a longitudinal axis 1, is larger than the width of the package 100, or in other words the extension of the bottom panels 122, 125 and top panels 120, 123 parallel to a transversal axis t.

A first unlocking element 140 and a first protrusion 150 are located on an outer surface of a second top panel 123 of the second portion 111. Further, a second unlocking element 141 and a second protrusion 151 are located on an outer surface of a second side panel 124 of the second portion 111 and a third unlocking element 142 and a third protrusion 152 are located on an outer surface of a second bottom panel 125 of the second portion 111. All three unlocking elements 140, 141, 142 are then located on different panels 123, 124, 125 and thus distant to each other, which may prevent the opening by children with an insufficient hand span.

A first cavity 160 is located on an inner surface of a first top panel 120 of the first portion 110, a second cavity 161 is located on an inner surface of the first side panel 121 of the first portion 110 and a third cavity 162 is located on an inner surface of a first bottom panel 122 of the first portion 110.

However, the present invention is not limited to the specific arrangement of the cavities, protrusion and unlocking elements where the protrusions communicate with the unlocking elements and it would alternatively be possible to use the package of the present invention in an arrangement where the cavities are formed to communicate with the unlocking elements. In the same way, the cavities may alternatively be formed on the second portion while the protrusion may be formed on the first portion.

The cavities 160, 161, 162 are formed as rectangular recesses. The first cavity 160 cannot be seen from the perspective shown in FIG. 2. The positioning of the cavities 160, 161, 162 within the first portion 110 is chosen such that the cavities 160, 161, 162 correspond to the respective positions of the protrusions 150, 151, 152 and the unlocking elements 140, 141, 142 of the second portion 111. The second top, second side and second bottom panels 123, 124, 125 comprise respective recessed parts 123', 124', 125' on each panel 123, 124, 125. These recessed parts 123', 124', 125' face in the direction of the first portion 110, when the package is in a closed state. The protrusions 150, 151, 152 of the second portion 111 are positioned on said recessed parts 123', 124', 125'.

When first portion 110 and second portion 111 are rotated such to move towards each other, the first top panel 120, first side panel 121 and the first bottom panel 122 come into contact and partially overlap with the recessed parts 123', 124', 125' of the respective second panels 123, 124, 125. The first portion 110 and second portion 111 are fixed such on the rear panel 128 such that the first panels 120, 121, 122 of the first portion 110 will be at least partly received by the respective first panels 120, 121, 122 of the second portion 111. Once the first portion 110 and second portion 111 interlock to engage the closed state, the combined side surface formed by the respective panels of the first portion 110 and second portion 111 forms a planar surface. In other words, the first portion 110 and second portion 111 terminate in their adjoining region in the closed state such to form a flat surface without any steps at the boundary between the first portion 110 and second portion 111.

In order to more securely fix the package 10*o* in the closed state, a flip-top lid 130 is hingedly connected to the rear panel 128. The connections of the flip-top lid 130 are positioned on each side of an upper portion of the rear panel 128 at the same height such that the lid 130 can be rotated around an axis extending along the upper side of the rear panel 128 and perpendicular to the longitudinal axis 1. The lid 130 is formed as a rectangular loop such that the lid 130 is capable of encompassing the first portion 110 and the second portion 111, when the package 100 is in the closed state. An advantage may be that the package 100 resembles a conventional cigarette package.

The package 100 further comprises a third portion 112 with one third recess 117 for accommodating a product. This third portion 112 extends perpendicular to the rear panel 128 such that the third portion 112 is received by the first portion 110 and the second portion 111, when the package 100 is closed (i.e. in the closed state). The third portion 112 is positioned at a bottom side of the rear panel 128 and formed in a cuboid shape. The number of third recesses 117 is one, thus adapted to accommodate one product. An advantage is that further storage may be provided through the third portion 112.

In order to enclose the third portion 112 within the package 100, the first portion 110 comprises a first inner pocket 180 and the second portion 111 comprises a second inner pocket 181 opposite to the first pocket 180, such that a combined pocket is formed which is adapted to receive the third portion 112 when the package 100 is in the closed state.

The unlocking elements 140, 141, 142 are formed as cantilevers within the second top, second side and side bottom panels 123, 124, 125 connected to the respective protrusions 150, 151, 152. The cantilevers are positioned within gaps of the respective first panels 123, 124, 125 and are slightly recessed with respect to the corresponding first panels 123, 124, 125. Each of the unlocking elements 140, 141, 142 is in mechanical communication with the respective protrusion 150, 151, 152 such that a movement of the unlocking element 140, 141, 142 result in movement of the respective protrusion 150, 151, 152 in relation to the respective cavity 160, 161, 162. Upon pressing the unlocking elements 140, 141, 142 simultaneously, the cantilevers are moved such that the cavities 160, 161, 162 of the first portion 110 unlock from the protrusions 150, 151, 152 of the second portion 111. It is expressed that pressing only some of the unlocking elements 140, 141, 142 will hinder opening of the package 100 because the at least one unlocking element 140, 141, 142 which is not pressed (or onto which no mechanical pressure is applied) will remain in a locked state (together with the respective cavity 160, 161, 162 thereby hindering relative movement of first and second portions 110, 111. Once pressure is released from the pressed unlocking elements 140, 141, 142, the respective protrusions 150, 151, 152 will re-engage with the respective cavities 160, 161, 162 as far as the first and second portions 110, 111 have not been rotated back into the open state.

However, the present invention is not limited to the specific form of the unlocking elements as cantilevers and it would alternatively be possible to use the package of the present invention in with other unlocking elements such as buttons, rods and the like.

In the present embodiment, the unlocking elements 140, 141, 142 are formed of an elastic material such that they automatically move back from an unlocking position into a locking position once pressure is removed.

The first recesses 115 and second recesses 116 are elongated parallel to a longitudinal axis 1, which may allow accommodating products in an upright position thereby preventing unwanted leakage.

The interior of each portion 110, 111 is vacuum-formed (thermo-formed). Vacuum-forming is a way of manufacturing plastic components. Plastic sheets are heated to a defined temperature and placed over a mould. A vacuum may then be applied to draw the plastic onto the mould. The plastic may adopt the shape of the mould and may then be removed. An advantage may be here that a precision of the created structures is very high.

The products which can be stored may be electronic smoking devices and/or electronic smoking device components. For example USB charger, cartomizers and batteries may be stored.

The exterior of each portion 110, 111 (here not visible) may be formed of a cardboard material. An advantage may be that the package resembles more a conventional cigarette package, which becomes more evident in FIG. 5.

FIG. 3 shows a package 100 of an embodiment of the present invention in the closed state. In this closed state of the package 100, the first recesses 115 and the one second recess 116 are inaccessible to a user. The first portion 110 is interlocked with the second portion 111. In particular, compared to FIG. 2, the first panels 120, 121, 122 overlap with the recessed parts 123', 124', 125' of the second panels 123, 124, 125, which are thus partly covered in the closed state of the package 100. The first panels 120, 121, 122 and the second panels 123, 124, 125 form a common outer surface in the closed sate. A common outer surface may be planar or have a small step which is defined by the thickness if the cardboard material. Such thickness may be less than 3 mm, less than 2 mm or even less than 1 mm.

The flip-top lid 130 is in an open state in the embodiment of FIG. 3. The lid 130 can be rotated such that it encompasses the first portion 110 and the second portion 111. Furthermore, the first unlocking element 140 and the second unlocking element 141 are visible from the perspective of FIG. 3, which, upon applying simultaneous pressure, unlock the cavities 160, 161, 162 from the protrusions 150, 151, 152 which is shown in FIG. 4 in more detail.

An opening of the package 100 by hand, when the package is in a closed state, may then require the use of three fingers to process the opening mechanism thus simultaneously unlocking the cavities 160, 161, 162 of the first portion 110 from the protrusions 150, 151, 152 of the second portion 111.

The distance d between the first unlocking element 140 and the third unlocking element (not visible here) is indicated within the figure. This distance may be larger than 2 cm, 3 cm, 4 cm or larger than 5 cm. An advantage may be that children might not have a sufficient hand span to press the corresponding unlocking elements simultaneously. A maximum distance between two unlocking elements may be smaller than 6 cm, 8 cm, 10 cm or smaller than 12 cm.

Figure 4:
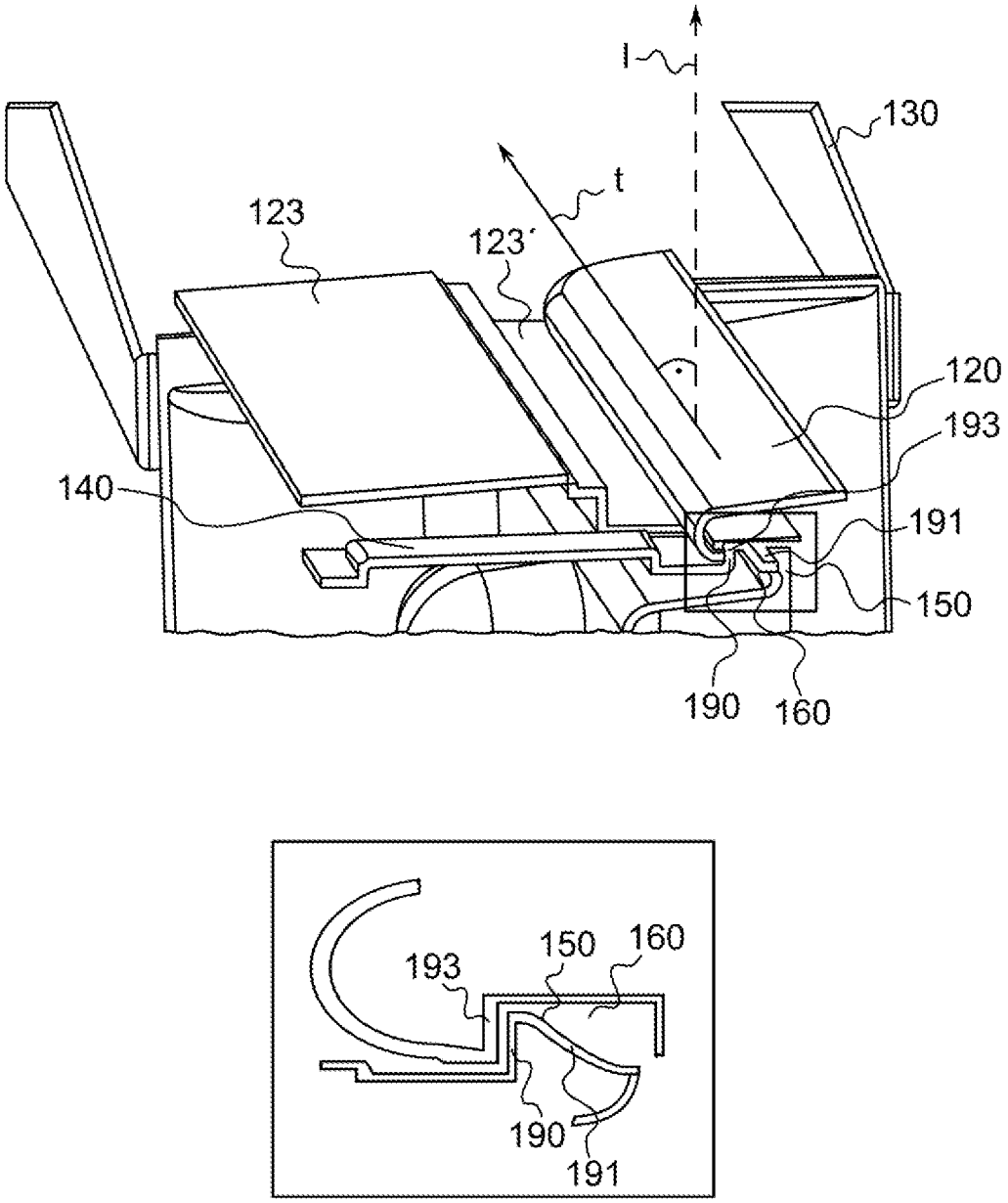
FIG. 4 is a detailed schematic illustration of the locking and unlocking function of an embodiment of the invention.

FIG. 4 shows a perspective view of the locking mechanism of an embodiment of the present invention in more detail. An enlarged cross-sectional view of a pair of cavity 160 and protrusion 150 is shown in the lower box.

The unlocking element 140 is formed as a cantilever which extends perpendicular to the transversal axis t within the plane of the top panels 120, 123. The cantilever is slightly recessed from the second top panel 123. In transversal direction, parallel to the transversal axis t, the cantilever is separated from the second top panel 123, and according cantilever bends under when a pressure is applied that exceeds a predefined threshold value, the pressure (or related force) extending (anti-)parallel to the longitudinal axis 1.

The first protrusion 150 is connected to the unlocking element 140. The profile of the protrusion 150 exhibits a particular form with a first flank 190 and a second flank 191. The first flank 190 exhibits a large slope directed substantially perpendicular to the extension of the cantilever, thus forming an edge parallel to the longitudinal axis 1. The second flank 191 provides a negative minor slope with respect to the longitudinal axis 1, where a slope with about m=−1 is used.

The first top panel 120 provides an outer and an inner surface. The inner surface provides a first cavity 160. The cuboid-shaped recess of the cavity 160 develops a first edge 193 and a second edge, where the first edge 193 is in side contact with the first flank 191 of the protrusion 150 in the closed state such that the first cavity 160 encompasses the first protrusion 150 and thus interlocks with the first protrusion 150.

Due to the finite slope of the second flank 191, for closing the package 100 from the open state to the closed state, the first edge 193 of the first portion 110 can be shifted up to the second flank 191 due to the finite slope until the first protrusion 150 snaps into the first cavity 160. Then, the first edge 193 contacts the first flank 191 from the side as shown in FIG. 4.

The opening of the closed state is performed upon pressing the cantilever. The applied force (or at least a part of the applied force) is directed in perpendicular direction to the respective first panel. The cantilever then bends due to its elastic response to the applied force. Then, the first protrusion 150 is moved with respect to the first cavity 160 such that the first cavity 160 is released from the first protrusion 150.

The other unlocking elements 141, 142 are constructed in the same way. The directions of the applied forces required to unlock the respective cavities 160, 161, 162 from the respective protrusions 150, 151, 152 are as well directed perpendicular to the respective panels 123, 124, 125. The direction of the initial rotation from the closed state to separate the two portions 120, 121 from each other, if all three cavities 160, 161, 162 are released from the three protrusions 150, 151, 152 is perpendicular to the directions of the three applied forces.

To open the package 100 the following method steps can be taken: a) providing a package for accommodating products according to the above described embodiments, b) opening a flip-top lid encompassing the package and c) pressing all unlocking elements simultaneously whilst pulling apart the first portion from the second portion of the package. In the last step the cavities 160, 161, 162 unlock from the protrusions 150, 151, 152 due to the simultaneously applied pressure, thus the two portions 110, 111 can be opened like a book and rotated away from each other.

To close a package 100 for accommodating products the following method steps can be taken: a) providing a package for accommodating products according to the above described embodiments in an open state, b) pushing the first portion of the package onto the second portion of the package until the cavities of the first portion interlock with the protrusions of the second portion and c) closing a flip-top lid encompassing the package.

A first force may be required to unlock the first cavity 160 from the first protrusion 150, a second force may be required to unlock the second cavity 161 from the second protrusion 151, a third force may be required to unlock the third cavity 162 from the third protrusion 152, the first force and the third force being larger than the second force. An advantage may be that larger forces can be applied to the opposing second top panel 123 and second bottom panel 125 (by the thumb and an opposing finger) thereby maintaining a facilitated opening mechanism for an adult user having sufficient hand span while simultaneously increasing safety in terms of avoid unauthorised use by children.

A force (threshold value) required to unlock the cavities from the protrusions may be larger than 0.5 N, 1 N, 1.5 N, 2 N, 3 N or larger than 5 N. An advantage may be that children may lack the required power and coordination for unlocking the package 100.

FIG. 5 shows a packaging 100 according to an embodiment of the present invention in a closed state. The packaging 100 comprises a first portion 110 and a second portion 111. The exterior of each portion 110, 111 is formed of cardboard material and comprises a lid 130 which is formed as a flip-top lid. An advantage may be that the package 100 resembles a conventional cigarette package. Further, the cardboard material hides the unlocking elements 140, 141, 142, such that from the exterior perspective it is not obvious where forces need to be applied to open the package 100.

In summary, in one aspect the package for accommodating products comprises a first portion hingedly connected to a first side of a rear panel, a second portion hingedly connected to a second side of the rear panel, the second side being opposite to the first side. At least one of the first and second portion comprises at least one recess adapted to accommodate a product. The first portion, the second portion and the rear panel at least partly form a receptacle adapted for accommodating said at least one recess. The first portion and the second portion are movable between an open state of the package in which the at least one recess is accessible to a user and a closed state of the package in which the at least one recess is inaccessible to a user. Further a plurality of separate pairs of cavities and protrusions are comprised, wherein the cavities are formed at the first portion and the protrusions are formed at the second portion. Each pair comprises an unlocking element adapted such that, in the closed state, the respective cavity unlocks from the respective protrusion, when a pressure is applied onto the respective unlocking element.

An advantage may be that the package can be opened like a book to access the stored product. This feature may advantageously be accompanied by a locking function and accordingly an opening mechanism, which may prevent children to open the package or at least delay the time to identify the opening mechanism of the package. The opening mechanism and the book-like treatment of the package may provide a completely new product/package experience and an element of surprise and discovery when interacting with the package. A further advantage may be the modular form of the package, which may reduce costs and may increase the efficiency in the production process.

The number of pairs of protrusions and cavities is at least three.

A first unlocking element and a first protrusion may be located on an outer surface of a second top panel of the second portion, a second unlocking element and a second protrusion may be located on an outer surface of a second side panel of the second portion, a third unlocking element and a third protrusion may be located on an outer surface of a second bottom panel of the second portion. An advantage may be that all three unlocking elements are located on different panels and distant to each other, which may prevent the opening by children with an insufficient hand span.

A first cavity may be located on an inner surface of a first top panel of the first portion, a second cavity may be located on an inner surface of a first side panel of the first portion, a third cavity may be located on an inner surface of a first bottom panel of the first portion.

A flip-top lid may be hingedly connected to the rear panel. An advantage may be that the package resembles a conventional cigarette packing, which may allow a brand to keep consumer cues with the traditional smoking experience.

The flip-top lid may be a rectangular loop, such that the flip-top lid may encompass the first portion and the second portion, when the package is in the closed state.

The package may comprise a third portion with at least one third recess for accommodating products, the third portion extending perpendicular to the rear panel such that the third portion may be received by the first portion and the second portion, when the package is in the closed state. An advantage may be that additional storage may be provided.

A first portion may comprise a first inner pocket and the second portion may comprise a second inner pocket opposite to the first pocket, such that a combined pocket may be formed, when the package may be in a closed state, the combined pocket being adapted to receive the third portion.

The unlocking elements may be formed as cantilevers connected to the respective protrusions, such that upon pressing, the cantilever bends and the cavities of the first portion are moved with respect to the respective protrusions, such that the first portion unlocks from the second portion.

The first recesses and second recesses may be elongated parallel to a longitudinal axis. This may allow accommodating products in an upright position, which might prevent unwanted leakage.

The exterior of each portion may be formed of cardboard material. An advantage may be that the package resembles more a conventional cigarette package.

A first force may be required to unlock the first cavity from the first protrusion, a second force may be required to unlock the second cavity from the second protrusion, a third force may be required to unlock the third cavity from the third protrusion, the first force and the third force being larger than the second force.

The forces required to unlock are larger than 0.5 N, 1 N, 1.5 N, 2 N or larger than 3 N. An advantage may be that a child might not have the power to apply the mentioned forces.

A distance between two unlocking elements may be larger than 3 cm, 4 cm or larger than 5 cm. An advantage may be that a child may not be capable of reaching the two unlocking elements with one hand.

A maximum distance between two unlocking elements may be smaller than 5 cm, 8 cm, 11 cm or smaller than 14 cm.

The products may be electronic smoking devices and/or electronic smoking device components. This may be for example batteries, USB charger or cartomizers etc.

The interior of each portion may be vacuum-formed (thermoformed). Vacuum-forming may be a way of manufacturing plastic components. Plastic sheets may be heated to a defined temperature and placed over a mould. A vacuum may then be applied to draw the plastic onto the mould. The plastic may adopt the shape of the mould and may then be removed. The precision of the resulting shapes and cavities may be advantageously high. A further advantage may be that the vacuum-formed interior can be exchanged for different brands.

Another aspect of the invention may be a method of opening a package for accommodating products comprising the steps a) providing a package for accommodating products according to the above described embodiments, b) opening a flip-top lid encompassing the package and c) pressing all unlocking elements simultaneously whilst pulling apart the first portion from the second portion of the package.

Another aspect of the invention may be a method of closing a package for accommodating products comprising the steps a) providing a package for accommodating products according to the above described embodiments in an open state, b) pushing the first portion of the package onto the second portion of the package until the cavities of the first portion interlock with the protrusions of the second portion and c) closing a flip-top lid encompassing the package.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

Although several embodiments have been described above with a certain degree of particularity, those skilled in the art could make numerous alterations to the disclosed embodiments without departing from the spirit of the present disclosure. It is intended that all matter contained in the above description or shown in the accompanying drawings shall be interpreted as illustrative only and not limiting. Changes in detail or structure may be made without departing from the present teachings. The foregoing description and following claims are intended to cover all such modifications and variations.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation. Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

LIST OF REFERENCE SIGNS

10 electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 wick
32 central passage
34 liquid reservoir
36 air inhalation port
38 air inlets
100 package
110 first portion
111 second portion
112 third portion
115 first recess
116 second recess
117 third recess
120 first top panel
121 first side panel
122 first bottom panel
123 second top panel
124 second side panel
125 second bottom panel
123' first recessed part
124' second recessed part
125' third recessed part
128 rear panel
130 lid
140 first unlocking element
141 second unlocking element
142 third unlocking element
150 first protrusion
151 second protrusion
152 third protrusion
160 first cavity
161 second cavity
162 third cavity
170 first side
171 second side
180 first pocket
181 second pocket
190 first flank
191 second flank
193 first edge
d distance
l longitudinal axis
t transversal axis

What is claimed is:

1. A package for accommodating products, comprising:

a first portion connected to a first side of a rear panel, a second portion connected to a second side of the rear panel, the second side being opposite to the first side, wherein at least one of the first and second portion comprises at least one recess adapted to accommodate a product, wherein the first portion, the second portion and the rear panel at least partly form a receptacle adapted for accommodating said at least one recess, the first portion and the second portion are movable between an open state of the package in which the at least one recess is accessible to a user and a closed state of the package in which the at least one recess is inaccessible to a user, a plurality of separate pairs of cavities and protrusions, wherein the cavities are formed at the first portion and the protrusions are formed at the second portion, wherein each pair comprises an unlocking element configured and arranged such that, in the closed state, the respective cavity unlocks from the respective protrusion in response to a pressure applied onto the respective unlocking element and facilitating a transition of the package to the open state.

2. The package according to claim 1, wherein the plurality of separate pairs of protrusions and cavities is at least three.

3. The package according to claim 2, wherein a first unlocking element and a first protrusion are located on an outer surface of a second top panel of the second portion, a second unlocking element and a second protrusion are located on an outer surface of a second side panel of the second portion and a third unlocking element and a third protrusion are located on an outer surface of a second bottom panel of the second portion.

4. The package according to claim 2, wherein a first cavity is located on an inner surface of a first top panel of the first portion, a second cavity is located on an inner surface of a first side panel of the first portion and a third cavity is located on an inner surface of a first bottom panel of the first portion.

5. The package according to claim 1, wherein a flip-top lid is hingedly connected to the rear panel.

6. The package according to claim 5, wherein the flip-top lid is a rectangular loop, such that the flip-top lid encompasses the first portion and the second portion, when the package is in the closed state.

7. The package according to claim 1, wherein the package comprises a third portion with at least one third recess for accommodating a product, the third portion extending perpendicular to the rear panel such that the third portion is received by the first portion and the second portion, when the package is in the closed state.

8. The package according to claim 7, wherein the first portion comprises a first inner pocket and the second portion comprises a second inner pocket opposite to the first pocket, such that a combined pocket is formed, when the package is in a closed state, the combined pocket being adapted to receive the third portion.

9. The package according to claim 1, wherein the unlocking elements are formed as cantilevers connected to the respective protrusions, such that upon pressing, the cantilever bends and the cavities of the first portion are moved with respect to the respective protrusions, such that the first portion unlocks from the second portion.

10. The package according to claim 1, wherein the first recesses and second recesses are elongated parallel to a longitudinal axis of the package.

11. The package according to claim 1, wherein the exterior of each portion is formed of cardboard material.

12. The package according to claim 3, wherein a first force is required to unlock the first cavity from the first protrusion, a second force is required to unlock the second cavity from the second protrusion, a third force is required to unlock the third cavity from the third protrusion, the first force and the third force being larger than the second force.

13. The package according to claim 12, wherein the forces are selected from the group consisting of: 0.5 N, 1 N, 1.5 N, 2 N, and larger than 3 N.

14. The package according to claim 1, wherein a distance (d) between two unlocking elements is selected from the group consisting of: 2 cm, 3 cm, 4 cm, and larger than 5 cm.

15. The package according to claim 1, wherein a maximum distance (d) between two unlocking elements is selected from the group consisting of: 6 cm, 8 cm, 10 cm, and 12 cm.

* * * * *